United States Patent [19]

King

[11] Patent Number: 4,995,238

[45] Date of Patent: Feb. 26, 1991

[54] CHILLED BEVERAGE CONTAINER DISPLAY BIN

[75] Inventor: Leslie C. King, Snellville, Ga.

[73] Assignee: Leggett & Platt, Incorporated, Carthage, Mo.

[21] Appl. No.: 530,998

[22] Filed: May 31, 1990

[51] Int. Cl.[5] ..... F25B 49/00

[52] U.S. Cl. ..... 62/125; 62/457.1; 62/462

[58] Field of Search ..... 62/457.1, 457.2, 457.3, 62/457.4, 457.8, 285, 288, 125, 128, 462

[56] References Cited

U.S. PATENT DOCUMENTS 4,220,048 9/1980 Grepiotis et al. ..... 62/125
4,946,032 8/1990 Stoddard et al. ..... 62/457.1

OTHER PUBLICATIONS

Coca Cola Display Equipment and Merchandising Catalog, Fall 1989-90, excerpts, pp. PFI-15, MED-17, MED-21, MED-24, PMD-4, and RTC 25.

*Primary Examiner*—Henry A. Bennet
*Assistant Examiner*—John Sollecito
*Attorney, Agent, or Firm*—Wood, Herron & Evans

[57] ABSTRACT

A chilled beverage display bin for containing and displaying iced beverage products. The bin comprises a stand and a bucket or beverage display container contained internally of the stand. A translucent or transparent drainage hose is connected to the bottom of the bucket and extends through the stand into a channel formed on the exterior of the stand such that the hose functions as a telltale of the level of liquid in the container, and when removed from the channel, facilitates drainage of liquid from the container without the need for a flow control valve.

8 Claims, 3 Drawing Sheets

CHILLED BEVERAGE CONTAINER DISPLAY BIN

BACKGROUND OF THE INVENTION

This invention relates to a container assembly for the storage, display, and advertisement of iced beverage products, such as bottled and canned beverages.

Container assemblies of the type with which this invention is concerned allow for easy access to chilled beverages so as to induce impulse purchase of an iced beverage product. The assembly is generally a self-supporting stand and a bucket or container which is large enough to hold a substantial quantity of ice and beverage bottles or cans, but small enough so as not to substitute for a more conventional display case for cooled beverage products Generally, these units are easily movable giving a store owner unlimited flexibility as to the location of the units within the store. The container assemblies are most often located near the entrance or exit of the store so as to give potential customers easy access to the beverages and to provide an eye-catching advertisement which everyone exiting or entering the store must pass.

Because these container assemblies are used to store iced beverage products, most have some means by which water can be drained from the assembly as the ice melts. Conventionally, these drainage means comprise a drainage opening in the bucket container and a flow control valve or spigot connected to the bottom of the container. Because there is no indication of how much water may be existent in the container or in the reservoir if the assembly includes a water reservoir beneath the container to catch overflow of melted ice, someone must regularly check the level of water in the container or reservoir. But, even if regularly checked so as to avoid overflow and spillage, the container or reservoir must be drained by locating a bucket beneath the drain spigot or valve and then draining the water from the bucket. This is oftentimes an inconvenient procedure, particularly when it must be conducted with more regularity than is necessary in order to avoid periodic overflow.

Beverage display bins of the type described hereinabove are also subject to problems with the drain valves. Of course, if those drain valves leak, there is a potential for water on the floor of a commercial establishment causing accidents if store visitors slip on the resulting water pool.

It has therefore been an objective of this invention to provide an improved iced beverage display bin or container assembly which eliminates the need to drain the bin of melted ice more regularly than is absolutely required in order to prevent overflow of the water resulting from melted ice contained in the bin.

Still another objective of this invention has been to provide an improved chilled beverage display bin which is less expensive than prior art bins and which eliminates the potential for spillage resulting from a defective drainage valve or spigot.

SUMMARY OF THE INVENTION

These objectives are achieved in accordance with the practice of this invention by a chilled beverage display bin in the form of a container assembly for containing and displaying iced beverage products, which assembly comprises a self-supporting open-top stand and a liquid-impervious storage tank or bucket supported from and contained internally of the stand. The bottom of the bucket has a drainage hose extending therefrom, which drainage hose is transparent or translucent and extends through a hole in the sidewall of the stand to the exterior thereof. From the exterior of the stand, this hose mounts in a channel of the stand and extends upwardly to the top of the stand. The hose contains no valve, but because it extends to the top of the stand and to the vertical height of the top of the bucket, the hose functions not only as a flow control device or valve, but also as a telltale of the level of water in the container or bucket of the assembly. Thereby, the need for a flow control valve or spigot is eliminated. All that is required to drain the bucket of water is to remove the hose from the channel of the stand and place the end of it in a bucket at a location below the level of water in the stand.

The container assembly of this invention eliminates the need for a potential leak source in the form of a flow control valve or spigot attached to the drainage opening of the ice containing bucket or container of the assembly, and thereby renders the assembly not only safer because of the elimination of the potential for a leaky valve, but additionally renders the assembly less expensive than prior art valve-containing assemblies. Additionally, the flexible hose serves as a telltale of level of water in the container of the assembly such that the container need not be emptied more often than absolutely necessary.

These and other objects and advantages of the invention will be more readily apparent from the following description of the drawings in which.

DESCRIPTION OF THE PREFERRED EMBODIMENT

With reference to the drawings, the container assembly 2 of this invention comprises a hollow, open-top, self-supporting body or stand 4, a liquid-impervious bucket or storage tank 6, and a flexible, transparent or translucent drainage hose 10 for draining liquid from the tank 6. The hose 10, in the stored position illustrated in FIG. 2, also functions as a telltale for enabling the level of liquid in the tank 6 to be visually determined from outside the assembly.

Figure 1:
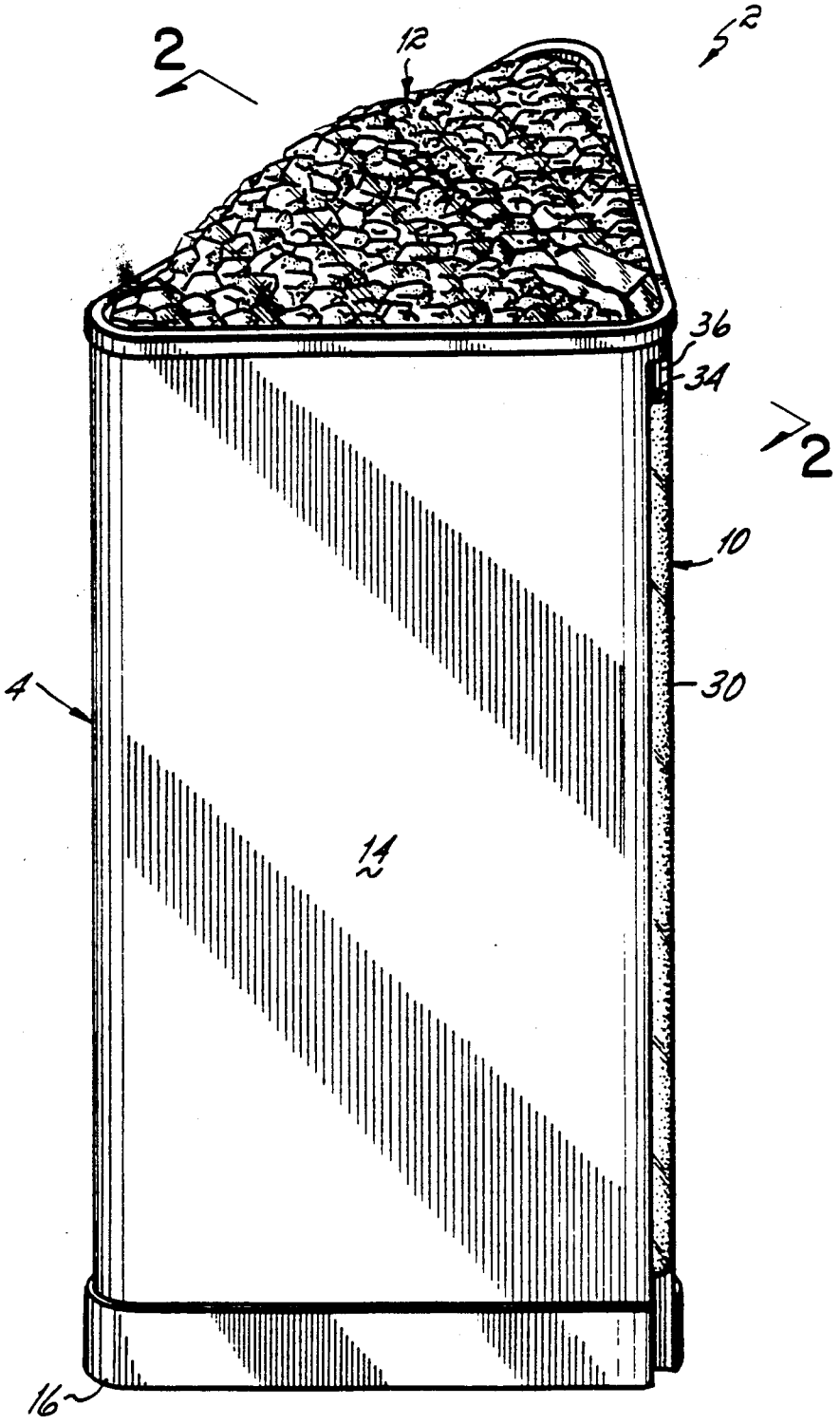
FIG. 1 is a perspective view of a container assembly for storage and display of iced beverage containers embodying the invention of this application.
Figure 3:
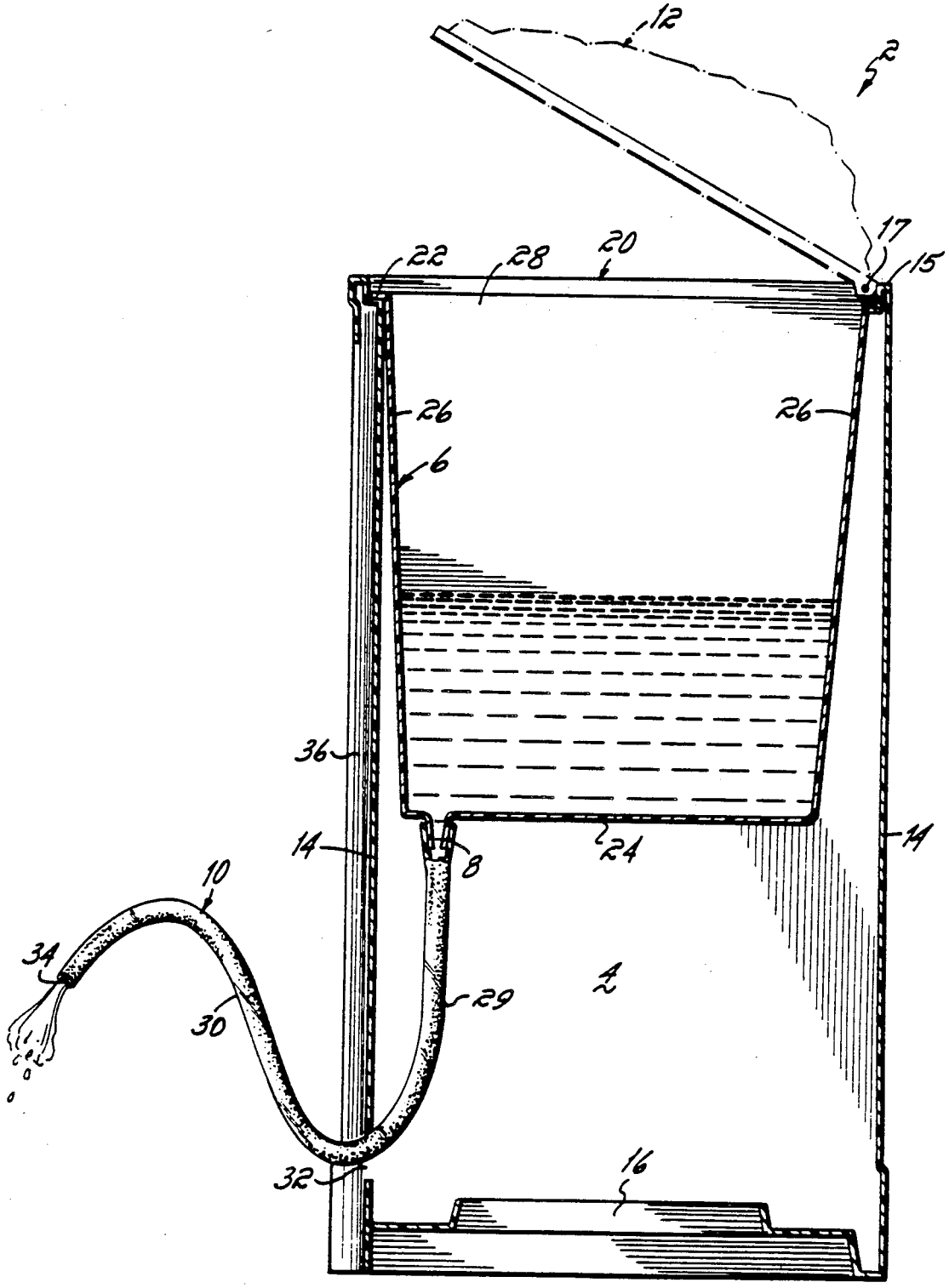
FIG. 3 is a cross-sectional view similar to FIG. 2, but illustrating the manner of draining water from the container of the assembly.

The container assembly 2 is, in one preferred embodiment, equipped with a top closure 12 which is hingedly connected to the top edge 15 of the sidewall 14 of the self-supporting body or stand 4. As illustrated in FIG. 3, the top closure 12 may be lifted away from the top 15 of the supporting body 4 about a hinge 17 to allow access to beverage containers 11, such as cans or bottles, contained in the storage tank 6. The top closure 12 is preferably transparent or translucent enough to allow visual inspection of the beverage containers 11 or other iced objects located within the container assembly 2 without requiring a person to lift the closure 12. In the preferred embodiment, the closure 12 is molded so as to simulate ice cubes, as is best illustrated in FIG. 1.

The self-supporting body or stand 4 of the container assembly 2 has a bottom 16, sidewalls 14, and an open top 20. The self-supporting body 4 is generally triangular when viewed in top plan and is hollow to allow the container or storage tank 6 to be contained within the supporting body 4 with a top flange 22 of the tank 6 resting atop the top edge 15 of the stand 4. Alternatively, the stand 4 and tank 6 may be rotationally molded as a common plastic casting.

Located inside and supported by the self-supporting body 4 is the bucket or storage tank 6. The storage tank 6 is liquid impervious so as to contain water derived from the melted ice 7 upon which the beverage containers are supported. The storage tank 6 has a bottom wall 24, sidewalls 26, and an open top 28. Preferably, the sidewalls 26 of the tank 6 define a triangle when viewed in top plan so that the tank is of the same general peripheral configuration as the stand 4. Though the top of the storage tank 22 is approximately flush with the top of the self-supporting body 20, the bottom wall 24 of the storage tank 6 is located in a plane substantially above the bottom 16 of the self-supporting body 4. This allows a customer access to items contained within the tank 6 without requiring the customer to reach down to floor level to reach an item.

The storage tank 6 is equipped with a drainage opening and spout 8 that is located in or near the bottom of the storage tank 24. This spout is provided to allow drainage of the storage tank 24 as ice 7 in the tank melts and liquid accumulates.

Attached to the drainage spout 8 is the transparent or translucent flexible drainage hose 10. Referring to FIG. 3, it will be seen that one end portion 29 of the drainage hose 10 is located internally of the self-supporting body 4 and another end portion 30 is located externally of the self-supporting body 4. The drainage hose 10 passes from inside the self-supporting body 4 to outside the self-supporting body 4 via an opening 32 in the sidewall 14 of the self-supporting body 4. The end 34 of the outside portion 30 of the drainage hose 10 is open and is releasably supported near the top 20 of the self-supporting body 4. When the storage tank 6 is not being drained, the external portion 30 of the drainage hose 10 extends approximately vertically upward from the opening 32 in the sidewall 14 of the self-supporting body 4 to approximately the top 20 of the self-supporting body 4.

Figure 2:
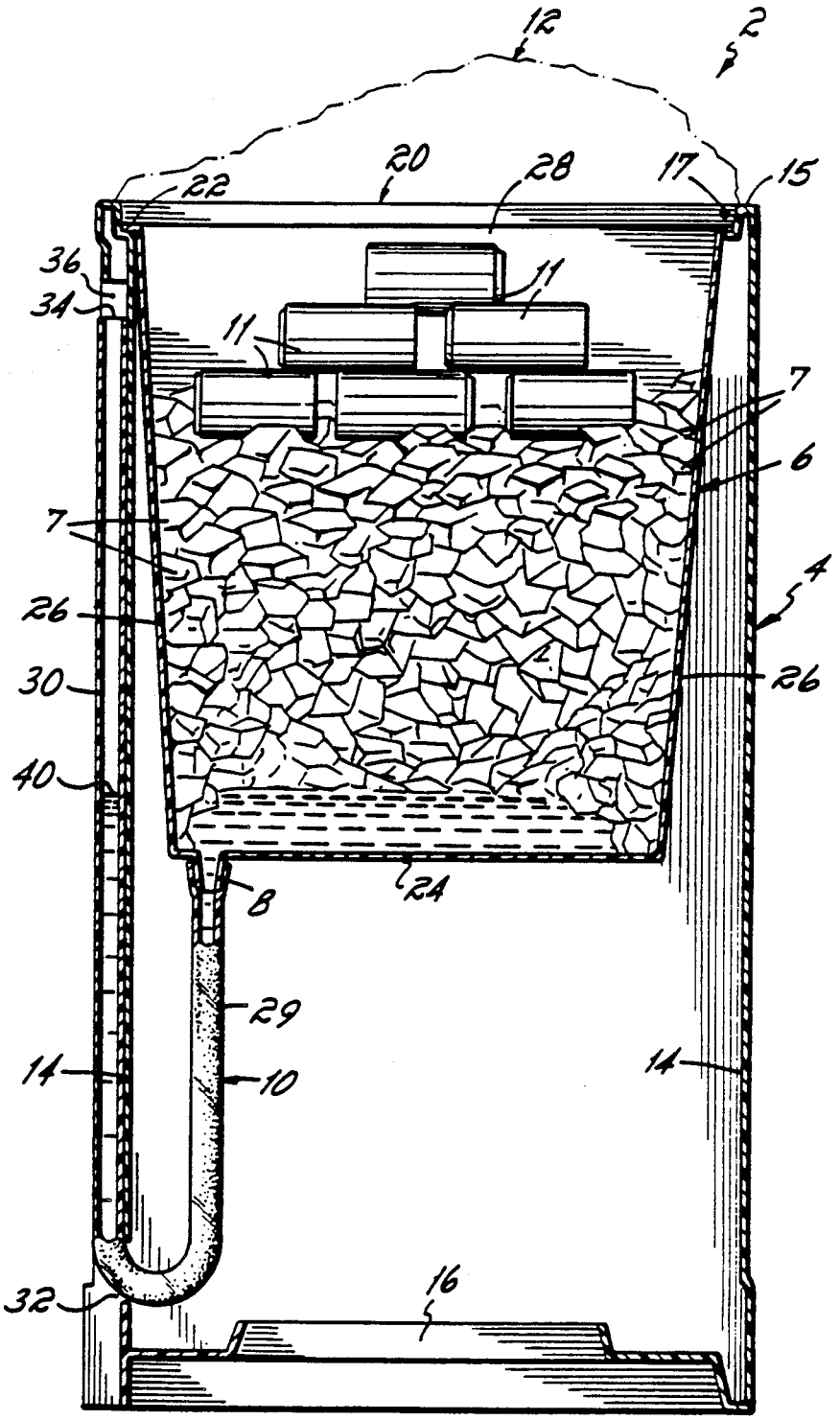
FIG. 2 is a cross-sectional view of the container assembly taken on line 2—2 of FIG. 1.

Referring to FIG. 2, the external portion 30 of the drainage hose 10 is preferably supported within a concave channel 36 in the sidewall 14 of the self-supporting body 4. The concave channel 36 runs vertically along the sidewall 14 of the self-supporting body 4 and is molded into the corner of the sidewall 14 as shown in more detail in FIG. 1. It is preferably sized relative to the outside diameter of the hose such that the hose snaps into and is frictionally retained within the channel. To ensure that the hose 10 remains in the channel and is not inadvertently dislodged therefrom, the top end of the hose may be inserted into a hole in the top of the stand. The external portion 30 of the drainage hose 10 is removable from the concave channel 36 to facilitate drainage (see FIG. 3) and is returnable to an upright vertical position after the tank has been completely drained (see FIG. 2). When in an upright vertical position, the external portion 30 of the drainage hose 10 is substantially flush with the outer wall 14 of the self-supporting body 4 within the concave channel 36.

The drainage hose 10 is either translucent or transparent, and therefore, when the external portion 30 of the drainage hose 10 is secured in an upright vertical position within the concave channel 36, the hose 10 functions as a telltale of the level 40 of liquid in the storage tank 6 (see FIG. 2). When the external portion 30 of the hose 10 is in the upright vertical position with the open end 34 supported near the top 20 of the self-supporting body 4, the liquid in the storage tank 6 is contained without the use of a flow control valve. As long as the water level 40 within the storage tank 6 remains below the height of the open end 34 of the external portion 30 of the drainage hose 10, the liquid in the storage tank 6 will be contained as shown in FIG. 2. To drain the storage tank 6 then, the open end 34 of the external portion 30 of the drainage hose 10 is removed from its secured position near the top 20 of the self-supporting body 4 and positioned at a level lower than the level of water 40 in the storage tank 6 (see FIG. 3). Thereby, drainage is accomplished without the need of a flow control valve.

The primary advantage of the container assembly 2 described hereinabove over prior art container assemblies for displaying and merchandising chilled beverages is that it provides a very attractive and relatively inexpensive container for accomplishing this function which is more convenient to use and less prone to leakage than prior assemblies utilized for this same purpose. It also has the advantage, because it controls the drainage of water from the tank 6 without the utilization of a valve, of being less subject to leakage and more convenient to drain than prior assemblies utilized for this same purpose.

Although the foregoing description and the drawings describe and illustrate a container assembly that fulfills the objects and advantages sought therefor, variations and modifications are contemplated as may be apparent to those skilled in the art and may be encompassed within the scope of the claims.

Having described our invention, we claim:

1. A container assembly for containing and displaying iced products comprising a hollow, open top, self-supporting body having a bottom, a sidewall, and an open top, said self-supporting body having a vertical channel formed in the sidewall thereof, a liquid impervious storage tank supported from and contained internally of the self-supporting body, said storage tank having a bottom, a sidewall, and an open top, the bottom of the storage tank being located in a plane substantially above the bottom of the self-supporting body, a drainage opening located near the bottom of the storage tank, a transparent or translucent flexible drainage hose having one end portion located internally of the self-supporting body and connected to the drainage opening of the storage tank, an opposite end portion of the drainage hose being located externally of the self-supporting body, said opposite end portion of the drainage hose being removably supported within said vertical channel of said sidewall of said self-supporting body whereby said hose functions as a telltale of the level of liquid in said storage tank while contained in said channel and facilitates draining of liquid from said storage tank when removed from said channel.

2. The container assembly of claim 1 wherein an end of said opposite end portion of said hose is located near the top of said self-supporting body when said hose is located in said channel whereby said hose facilitates drainage of liquid from said tank without the provision of a flow control valve.

3. The container assembly of claim which further includes a top closure hingedly connected to a top edge of said sidewall of said self-supporting body.

4. A container assembly for containing and displaying iced products comprising a hollow, open top, self-supporting body having a bottom, a sidewall, and an open top, said bottom of said self-supporting body being adapted to be floor supported, a liquid impervious storage tank supported from and contained internally of the self-supporting body, said storage tank having a bottom, a sidewall, and an open top, the bottom of the storage tank being located in a plane substantially above the bottom of the self-supporting body, a drainage opening located near the bottom of the storage tank, and a flexible drainage hose having one end portion located internally of the self-supporting body and an opposite end portion located externally of the self-supporting body, said one end portion of said hose having a first end connected to the drainage opening of said storage tank and said opposite end portion of said hose having a second end releasably supported near the top of said self-supporting body, by a releasable support means whereby said hose functions as a telltale of the level of liquid in said storage tank while supported near the top of said self-supporting body and facilitates draining of liquid from said storage tank without the provision of a flow control valve when not supported near the top of said self-supporting body.

5. The container assembly of claim 4 which further includes a top closure hingedly connected to a top edge of said sidewall of said self-supporting body.

6. The container assembly of claim 5 wherein said flexible drainage hose is translucent or transparent so as to enable said hose to function as a telltale indicative of the level of liquid in said storage tank.

7. A container assembly for containing and displaying iced products comprising a hollow, self-supporting body having a bottom, a sidewall, and an open top, a concave channel in the sidewall of the self-supporting body extending vertically from near the bottom of the self-supporting body to near the top of the self-supporting body, said channel being located in an exterior surface of the self-supporting body, a liquid-impervious storage tank having a bottom wall, sidewall, and open top, the sidewalls of the storage tank being of the same peripheral shape as the sidewall of the self-supporting body, said storage tank being located inside and supported by the hollow, self-supporting body with the top of the storage tank located approximately flush with the top of the self-supporting body and the bottom of the storage tank located in a plane substantially above the bottom of the self-supporting body, a drainage opening located near the bottom of the storage tank, a flexible drainage hose having one end connected to the drainage opening, a first portion of the drainage hose extending from the drainage opening of the storage tank to outside the sidewall of the self-supporting body via an opening in the sidewall of the self-supporting body, a second portion of the hose located on the exterior of the sidewall of the self-supporting body extending approximately vertically upwardly from the opening in the sidewall to approximately the top of the self-supporting body, said second portion of said hose being located flush against the outer wall of the self-supporting body within said concave channel, said second portion of the drainage hose being removable from the concave channel and away from the side of the self-supporting body to facilitate drainage of liquid from the storage tank and being completely returnable to an upright vertical position within the concave channel upon completion of drainage.

8. The container assembly of claim 7 wherein said hose is sufficiently translucent so as to enable said hose to function as a telltale indicative of the level of liquid in said storage tank so long as said hose is located within said concave channel.

* * * * *